US006609381B1

(12) United States Patent
Morgan

(10) Patent No.: US 6,609,381 B1
(45) Date of Patent: Aug. 26, 2003

(54) CONTROLLED FILL STATION FOR DELIVERY OF A MEASURED AMOUNT OF CRYOGENIC GAS TO A CYLINDER

(76) Inventor: Louis A. Morgan, 805 Rancho Estates Blvd., Yukon, OK (US) 73099

( * ) Notice: Subject to any disclaimer, the term of this patent is extended or adjusted under 35 U.S.C. 154(b) by 0 days.

(21) Appl. No.: 10/147,646

(22) Filed: May 16, 2002

(51) Int. Cl.[7] ..... F17C 7/02

(52) U.S. Cl. ..... 62/50.1; 141/83; 222/4; 222/56

(58) Field of Search ..... 62/50.1; 222/56, 222/4; 141/83

(56) References Cited

U.S. PATENT DOCUMENTS

| | | | | |
|---|---|---|---|---|
| 3,272,238 A | * | 9/1966 | Groppe | 62/50.1 |
| 4,100,759 A | | 7/1978 | Tyree | |
| 4,903,741 A | | 2/1990 | Ibanez | |
| 5,082,143 A | | 1/1992 | Schramm, Jr. | |
| 5,699,839 A | * | 12/1997 | Dehne | 62/50.1 |
| 5,787,940 A | * | 8/1998 | Bonn et al. | 62/50.1 |
| 5,916,246 A | | 6/1999 | Viegas | |
| 5,953,923 A | | 9/1999 | Davies | |
| 6,354,088 B1 | | 3/2002 | Emmer et al. | |

* cited by examiner

*Primary Examiner*—Ronald Capossela
(74) *Attorney, Agent, or Firm*—Randal D. Homburg

(57) ABSTRACT

The present invention is an integrated unit liquified gas fill station attached to a cryogenic storage tank and pump which provides for a controlled delivery of a programed weighted amount of a cryogenic liquified gas, primarily carbon dioxide, to empty transfer tanks at the time of initial filling or subsequent refilling, to prevent dangerous overfilling of the tanks resulting in over-pressure explosions of the transfer tanks, the liquified gas fill station providing a programmable tare scale upon which the transfer tank is positioned, a cryogenic liquified gas bypass circulating system and a cryogenic liquified gas delivery system wherein the station operator selects a weighed amount of liquified gas appropriate for the capacity of the transfer tank to be programmed into the station, delivering the measured amount of cryogenic liquified gas to the attached transfer tank resting on the tare scale, and filling the transfer tank with the precise measured and weighed amount of cryogenic liquified gas after which the station automatically stops the filling process when the programmed weight of liquified gas has been delivered to the transfer tank.

5 Claims, 4 Drawing Sheets

CONTROLLED FILL STATION FOR DELIVERY OF A MEASURED AMOUNT OF CRYOGENIC GAS TO A CYLINDER

CROSS REFERENCE TO RELATED APPLICATIONS

None

I. BACKGROUND OF THE INVENTION

1. Field of Invention

The present invention is an integrated unit liquified gas fill station attached to a cryogenic storage tank and pump which provides for a controlled delivery of a programed weighted amount of a cryogenic liquified gas, primarily carbon dioxide, to empty transfer cylinders at the time of initial filling or subsequent refilling, to prevent dangerous overfilling of the cylinders resulting in over-pressure explosions of the transfer cylinders, the liquified gas fill station providing a programmable tare scale upon which the transfer cylinder is positioned, a cryogenic liquified gas bypass circulating system and a cryogenic liquified gas delivery system wherein the station operator selects a weighed amount of gas appropriate for the capacity of the transfer cylinder to be programmed into the station, delivering the measured amount of cryogenic liquified gas to the attached transfer cylinder resting on the tare scale, and filling the transfer cylinder with the precise measured and weighed amount of cryogenic liquified gas after which the station automatically stops the filling process when the programmed weight of liquified gas has been delivered to the transfer cylinder.

2. Description of Prior Art

The following United States patents were discovered and are disclosed within this application for utility patent. All relate to cryogenic liquid dispensing devices, specifically devices delivering, at least in part, compressed carbon dioxide gas. However, these devices do not disclose any automated system for the delivery of a programmable amount of the liquified gas to transfer cylinders by weight using the same material components.

The first referenced patent, U.S. Pat. No. 5,953,923 to Davies, discloses a fluid dispensing apparatus and method of dispensing the fluid, employing the use of a scale measuring device, primarily with regard to the deliver of refrigerant to a refrigerant system, as in automobiles. The disclosed device having a containing means including a containing chamber containing the delivery fluid and dispensing chamber containing a buffer gas separated by some type of deformable membrane which in turn delivers the pre-measured gas to a dispensing capsule. There are plural valves in this system involved in the delivery process, requiring a coordination of the opening and closing of these multiple valves in rapid succession to carry out its precision measurement. The present delivery system has only one valve diverging the liquid gas from the bypass system to the delivery system and the attached transfer system without any multi-chambered containing means or other gas involvement and is a direct delivery system to the transfer cylinder.

U.S. Pat. No. 4,100,759 to Tyree, Jr. deals more specifically with a gas recovery system contained on a vehicle, this system also having multiple valves and inner compression systems to cause a circulating gas to resume a liquid form by the creation of a carbon dioxide "snow". This system does not provide delivery of the gas to an outside transfer cylinder, and does not involve any weighed measurement of gas delivery.

U.S. Pat. No. 5,916,246 to Viegas, discloses a two step pressure reduction system for the delivery of high pressure gas to a lower pressure container, having a first, second and third pressure reduction regulator, and muffler to dampen the sound of vented gas, with pressure relief valves, hoses, manually activated bleed valves. It also has an electronic automated filling cutoff, but it is distinguished because it determines the cutoff by the volume of the tank, using a tank level sensor, which senses the full condition of the tank, causing the gas to be diverted to a solenoid operated purge valve. The present invention is distinguished by its electronic control sensor determining the "full" tank when a programmed weight is attained, measuring the weight of the gas delivered to the transport tank being filled. It also is distinguished by its solenoid diverting gas either to the circulating tubing or the delivery tubing, not diverting the gas to the open air or atmosphere, except for the purge mechanism to empty the minute contents of the deliver hose after the filling transport tank is completed.

In U.S. Pat. No. 6,354,088 to Emmer, an LP gas delivery system is disclosed employing a microprocessor controlled fill mechanism with a heat exchange apparatus to deliver saturated fuel to a tank, the delivery tank having the fill sensor which communicates the capacity data to the delivery system to optimize the saturation of the fuel to the tank. The heat exchanger is used to increase the pressure of the gas in the delivery tank, or saturate the fuel.

II. SUMMARY OF THE INVENTION

In the cryogenic gas industry, the delivery of a precise amount of a cryogenic liquified gas to a gas transport cylinder is critical. In the event that a very small amount of a cryogenic gas is place within a transport cylinder above the express capacity of such transport cylinder, the risk of a catastrophic explosion can be enhance exponentially. In order to prevent such overfilling, the present invention seeks to accomplish the controlled and measured filling of the transport tanks using a system that incorporates a tare scale allowing for the measurement of a programmed amount of liquified gas to fill the transport cylinders to a safe and uniform weighed volume of cryogenic liquified gas.

The primary objective of the invention is to provide a cryogenic liquified gas fill station that provides a predetermined weighted volume of liquified gas to be delivered to a transport tank from a bulk tank storage tank which automatically stops delivery of the liquified gas when the programmed volume is reached, returning the majority of the liquified gas in the system to the bulk storage tank at the conclusion of the filling process.

A second objective of the invention is to provide the liquified gas fill station with a three way solenoid valve integrated with a control manifold that circulates the cryogenic gas in the fill station to and from the bulk storage tank through circulating lines until delivery to a transport tank is commenced by the activation of the start relay, at which time the cryogenic liquified gas is diverted from the circulating lines to the delivery hose by the three way solenoid, filling the transport tank until the programmed measured weight of cryogenic is attained, the three way solenoid then returning the flow of the cryogenic liquified gas to the circulating lines.

A third objective of the invention is to provide this liquified gas fill station with a purge valve to clear a minute amount of gas left in the manifold to relieve pressure when the fill station is not in use, and an emergency bypass valve to return any overfill liquified gas to the bulk storage tank in the event an overfill occurs due to mis-programming of the system, the goal of these two objective to prevent any release of the cryogenic gas to the environment or the air in the workplace where the fill station is located.

III. DESCRIPTION OF THE DRAWINGS

The following drawings are submitted with this utility patent application.

IV. DESCRIPTION OF THE PREFERRED EMBODIMENT

Figure 1:
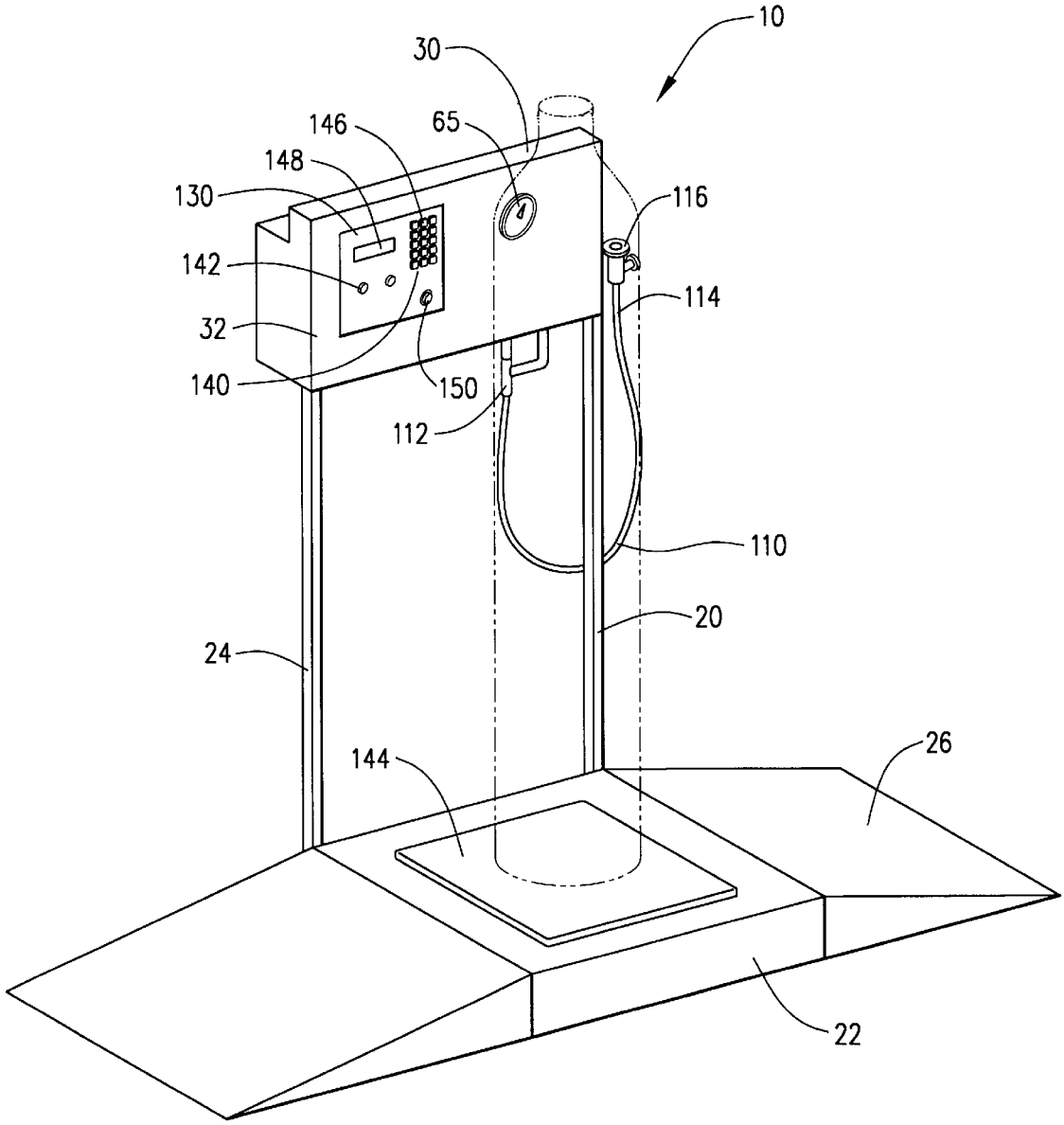
FIG. 1 is a front perspective view of a first embodiment of the liquified gas fill station.

The present invention, as shown in FIGS. 1–4 of the drawings, is a cryogenic liquified gas fill station 10 with an automatic programmable delivery cutoff for filling cryogenic liquified gas transfer tanks with a precise weighed amount of cryogenic liquified gas from a bulk cryogenic liquified gas storage tank 200 having a liquified gas pump 210 with a delivery hose 220, the liquified gas fill station 10 comprising essentially a support frame 20 containing a manifold 40 connecting to an inlet line 50 attached to the liquified gas pump 210 on the bulk cryogenic liquified gas storage tank 200, the manifold 40 further attached to a purge valve 60 for relieving any pressure within the liquified gas fill station 10, a pressure gauge 65, a primary bypass line 70 connected to a bypass regulator 72, further attaching to a return line 80 to the bulk cryogenic liquified gas storage tank 200, and an outlet line 90 connecting to a three-way solenoid valve 100, the three-way solenoid valve 100 further connecting to the return line 80 and a delivery line 110 having a solenoid connecting end 112 and a transfer tank end 114 to which is attached a transfer tank connector 116 for attaching the delivery line 110 to a cryogenic liquified gas transfer tank 300, the delivery line 110 having an emergency bypass valve 122 and an emergency secondary bypass line 120 connecting to the return line 80 for bleeding off any excess cryogenic liquified gas above the capacity of the transfer tank 300, returning the excess liquified gas to the bulk cryogenic liquified gas storage tank 200 instead of the working environment.

The entire liquified gas fill station 10 is controlled by an electronic control panel 130 integrated with a tare scale 140 upon which the transfer tank 300 is placed prior to a filling process, the electronic control panel 130 having a tare means 142 to bring the tare scale 140 to zero before the delivery of the cryogenic liquified gas to the transfer tank 300, the electronic control panel 130 then accepting a programmed acceptable weight of cryogenic liquified gas to be delivered to each transfer tank 300 to be filled. The electronic control panel 130 also connects to a start relay 150 which initiates the flow of cryogenic liquified gas to the delivery line 110 for delivery to the transfer tank 300, the tare scale 140 relaying the weight of the cryogenic liquified gas within the transfer tank 300, signaling the electronic control panel 130 when a programmed weight is attained, signaling the start relay 150 to activate the three-way solenoid valve 100, diverting the cryogenic liquified gas from the delivery line 110 to the return line 80, back to the bulk cryogenic liquified gas storage tank 200 to continue circulation.

When the liquified gas fill station 10 is not in use or when the liquified gas pump 210 is not activated, the purge valve 60 may be opened to relieve any remaining pressure in the liquified gas fill station 10 for safety purposes, which is the only time any cryogenic liquified gas should be released outside the closed system described.

Figure 2:
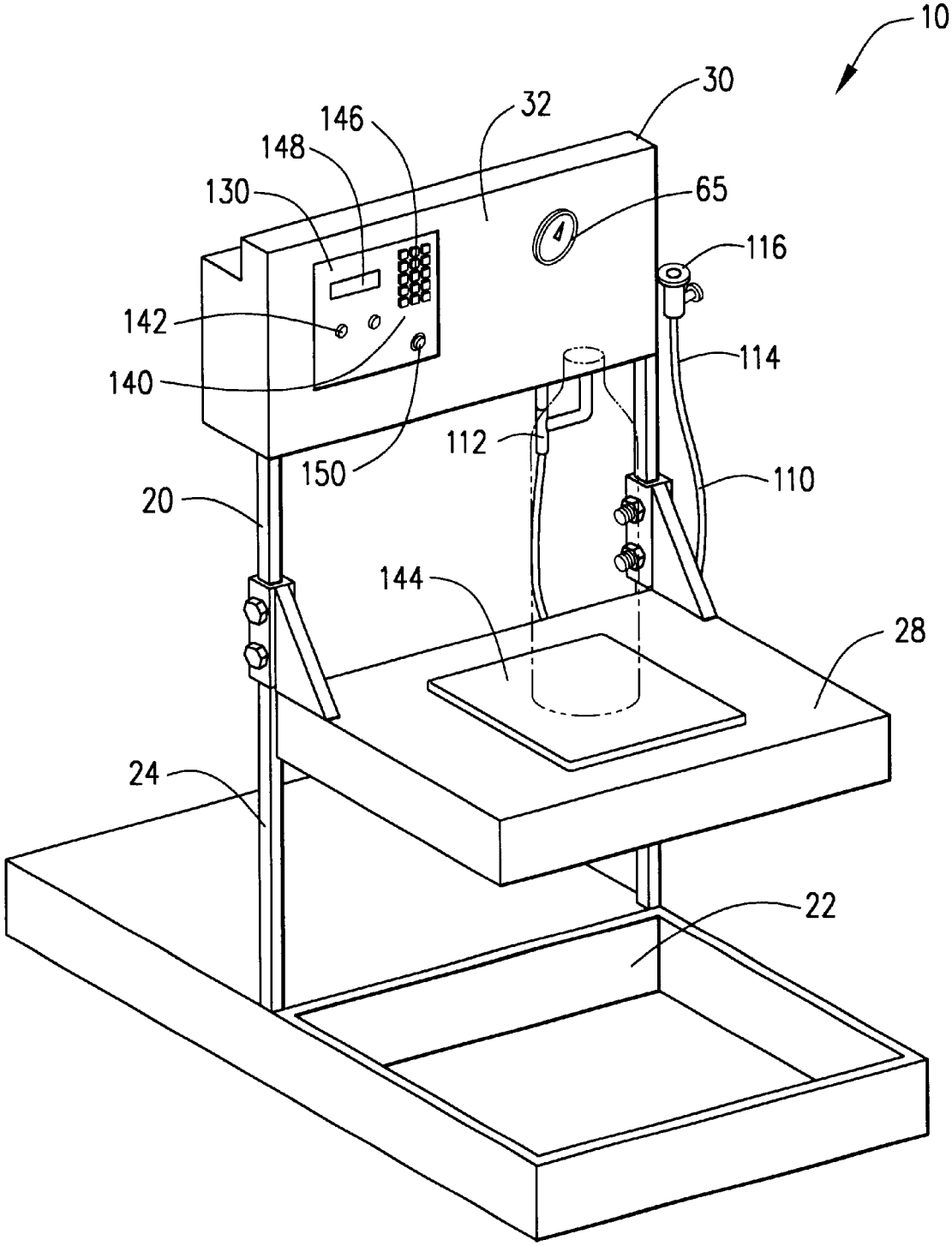
FIG. 2 is a front perspective view of a second embodiment of the liquified gas fill station.
Figure 3:
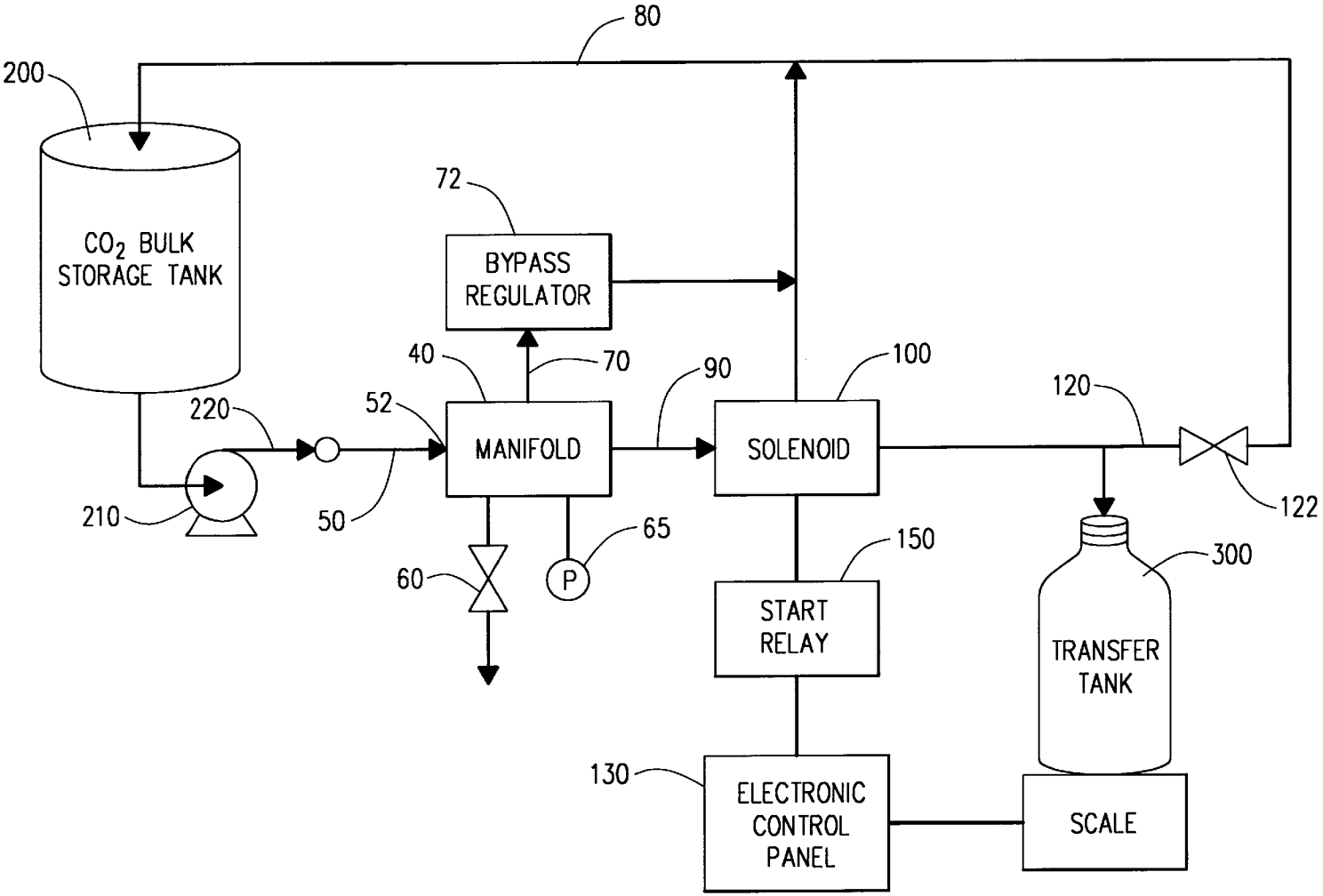
FIG. 3 is a component diagram of the liquified gas fill station.

More specifically, the support frame 20, as shown in FIGS. 1 and 2 of the drawings, is provided with a base support 22 with at least two vertical support posts 24 connecting to the base support 22, and a control panel box 30. In a first embodiment, as shown in FIG. 1, a weigh platform 144 of the tare scale 140 is incorporated within the base support 22, upon which the transfer tank 300 is located during the fill process, along with at least one detachable ramp 26 to roll a transfer tank 300 onto the weigh platform 144 within the base support 22. In a second embodiment, as shown in FIG. 2 of the drawings, an adjustable height weigh shelf 28 is included, within which the weigh platform 144 is located. The second embodiment is more suited for lower volume transfer tanks 300 which can be lifted onto the weigh shelf 28 containing the weight platform 144 for delivery of the liquified gas at a height allowing the transfer tank 300 to be connected and monitored at a level comfortable and safe to the user. The first embodiment is preferred for transfer tanks 300 of high volume which would be too heavy for lifting to an elevated height without risk of injury. In both embodiments, the delivery line 110 is shown in FIGS. 1 and 2, descending from the control panel box 30 with the transfer tank connector 116 available for connection to the transfer tank 300.

The three-way solenoid valve 100 is an electronically activated valve which directs a flow of liquified gas from a singular input line, which is referenced as the outlet line 90 from the manifold 40, to either of two output lines, in this disclosed invention and applied instance, either directing the flow of the liquified gas to the return line 80 or the delivery line 110. This three-way solenoid valve 100 is not intended to halt the flow of liquified gas, but instead, direct the flow of liquified gas.

Figure 4:
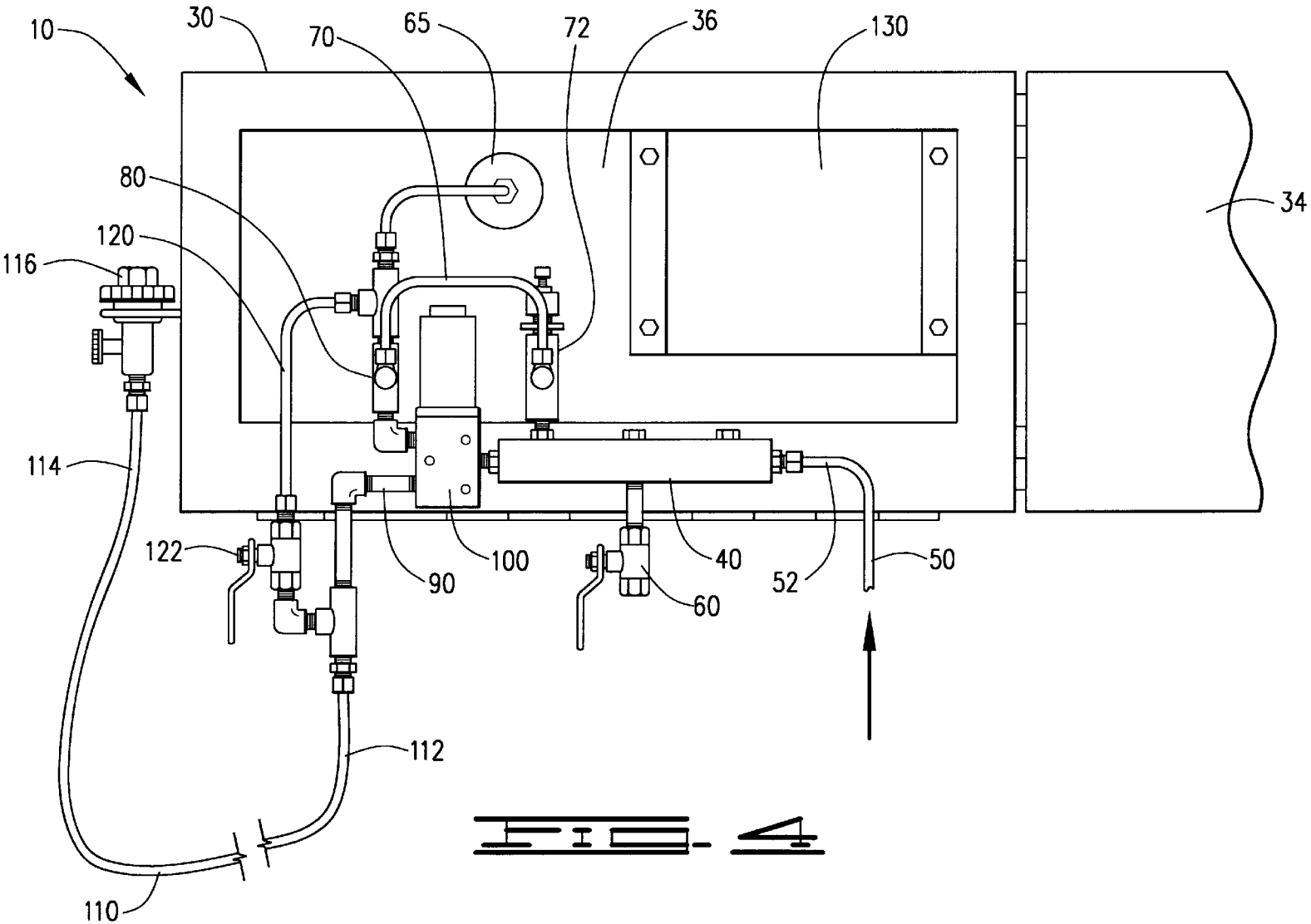
FIG. 4 is a rear view of the control panel box of the liquified gas fill station with the removable rear panel detached.

The control panel box 30 has a front surface 32, upon which the electronic control panel 130 is contained with a scale program input 146, a scale display 148, the start relay 150, and the pressure gauge 65. The control panel box 30, as shown in FIG. 4 of the drawings, also includes a removable rear panel 34 giving access to a control panel cavity 36 within which is situated the manifold 40, a manifold connector end 52 of the inlet line 50, the purge valve 60, the primary bypass line 70, the bypass regulator 72, the outlet line 90, the three-way solenoid valve 40, the return line 80, and the solenoid connector end 112 of the delivery line 110.

Using this liquified gas fill station 10 requires first connection of the liquified gas fill station 10 to the liquified gas pump 210 and the delivery hose 220 from the bulk cryogenic liquified storage tank 200, the delivery hose 220 attaching to the inlet line 50 connected to the manifold 40 with the return line 80 returning the cryogenic liquified gas to the bulk cryogenic liquified gas storage tank 200. A transfer tank 300 is then placed on the weigh platform 144, connected to the transfer tank connector 116 on the delivery line 110 and the scale program input 146 and scale display 148 are set to zero by activating the tare means 142. The liquified gas pump 220 is then activated, causing the cryogenic liquified gas to begin circulating in the liquified gas fill station 10, the three-way solenoid 100 directing the cryogenic liquified gas to the return line 80. The appropriate weighed amount of liquified gas is then programmed into the scale program input 146 of the electronic control panel 130, verified, the transfer tank 300 is opened, and the start relay 150 is depressed causing the liquified gas to be directed through the delivery line 110 into the transfer tank 300. The cryogenic liquified gas flows to the transfer tank 300 until the programmed weight is attained, wherein the weigh platform 144 sends an electronic signal to the electronic control panel 130 causing the three-way solenoid 100 to instantly direct the flow of liquified gas to the return line 80 and divert the flow of liquified gas to the delivery line 110. The transfer tank 300 is then closed, after which the emergency bypass valve 122 is opened, directing any remaining liquified gas from the delivery line 110 to the return line 80. The closed transfer tank 300 is then disconnected from the transfer tank connector 116. Another transfer tank 300 can then be filled, or, if no further transfer tanks 300 need filling, the liquified gas pump 210 is powered down after which the purge valve 60 may be opened to relieve any trace liquified gases that may remain in the liquified gas fill station 10. While the invention has been particularly shown and described with reference to a preferred embodiment thereof, it will be understood by those skilled in the art that changes in form and detail may be made therein without departing from the spirit and scope of the invention.

What is claimed is:

1. A cryogenic liquified gas fill station with an automatic programmable delivery cutoff for filling cryogenic liquified gas transfer tanks with a precise weighed amount of cryogenic liquified gas from a bulk cryogenic liquified gas storage tank having a liquified gas pump and a delivery hose, the liquified gas fill station comprising essentially:

a support frame;

a manifold with an inlet line and a bypass line connecting through a bypass regulator to a return line and an outlet line;

a three-way solenoid connected to the outlet line directing a flow of liquified gas to either the return line or a delivery line having a transfer tank connector attached to the transfer tanks; and an electronic control panel connecting to a tare scale upon which the transport tank is placed, wherein the electronic control panel is programmed to deliver a programmed weight of liquified gas to the transfer tanks through the three-way solenoid and the delivery hose and then causing the three-way solenoid to shut off the flow of liquified gas to the transfer tank, diverting the flow of liquified gas to the return line.

2. A cryogenic liquified gas fill station with an automatic programmable delivery cutoff for filling cryogenic liquified gas transfer tanks with a precise weighed amount of cryogenic liquified gas from a bulk cryogenic liquified gas storage tank having a liquified gas pump and a delivery hose, the liquified gas fill station comprising:

a support frame;

a manifold connecting to an inlet line attached to the liquified gas pump on the bulk cryogenic liquified gas storage tank, the manifold further attaching to;

a purge valve for relieving any pressure within the system;

a pressure gauge;

a primary bypass line connected to a bypass regulator which attaches to a return line to the bulk cryogenic liquified gas storage tank;

an outlet line connecting to a three-way solenoid valve, the three-way solenoid valve further connecting to;

the return line and a delivery line having a transfer tank connector for attaching the delivery line to a cryogenic liquified gas transfer tank, the delivery line having an emergency bypass valve and an emergency secondary bypass line connecting to the return line for bleeding off any excess cryogenic gas above the capacity of the transfer tank, returning the excess gas to the bulk cryogenic liquified gas storage tank instead of the environment; and an electronic control panel integrated with a tare scale upon which the transfer tank is placed prior to a filling process, the electronic control panel further comprising a tare means to bring the tare scale to indicate no weight on the tare scale prior to the delivery of the cryogenic gas to the transfer tank, the electronic control panel then accepting a programmed acceptable weight of cryogenic gas to be delivered to each transfer tank to be filled, the electronic control panel further connecting to a start relay which causes the three-way solenoid valve to either flow through the manifold and return to the bulk cryogenic liquified gas storage tank or flow to the delivery line for delivery of the cryogenic gas to the transfer tank, the tare scale relaying the weight of the cryogenic liquified gas within the transfer tank, signaling the electronic control panel when the programmed weight is obtained, and signaling the start relay to cause the three-way solenoid valve to divert the cryogenic liquified gas from the delivery line to the return line, back to the bulk cryogenic liquified gas storage tank to continue circulation.

3. The cryogenic liquified gas fill station as disclosed in claim 2, the support frame comprising:

a base support;

two vertical support posts connecting to the base support;

a control panel box, having a front surface upon which the electronic control panel is contained, the electronic control panel having a scale program input, a scale display, the start relay and the pressure gauge and a removable rear panel giving access to a control panel cavity within which is situated the manifold, a manifold end of the inlet line, the purge valve, the primary bypass line, the bypass regulator, the outlet line, the three-way solenoid valve, the return line, and the solenoid connector end of the delivery line;

a weight platform of the tare scale supplied within the base support, upon which the transfer tank is located during the fill process; and at least one ramp to roll the transfer tank onto the weigh platform within the base support intended for transfer tanks of high volume which would be too heavy for lifting to an elevated height without risk of injury.

4. The cryogenic liquified gas fill station as disclosed in claim 2, the support frame comprising:

a base support;

two vertical support posts connecting to the base support;

a control panel box, having a front surface upon which the electronic control panel is contained, the electronic control panel having a scale program input, a scale display, the start relay and the pressure gauge and a removable rear panel giving access to a control panel cavity within which is situated the manifold, a manifold end of the inlet line, the purge valve, the primary bypass line, the bypass regulator, the outlet line, the three-way solenoid valve, the return line, and the solenoid connector end of the delivery line;

an adjustable height weigh shelf within which a weight platform such adjustable height weigh shelf suited for lower volume transfer tanks which can be lifted onto the weight platform for filling at a height allowing the transfer tanks to be connected and monitored at a level comfortable and safe to the user.

5. A method for using the cryogenic liquified gas fill station as disclosed in claim 2, the method comprising the steps of:

connecting the liquified gas fill station to the liquified gas pump and the delivery hose from the bulk cryogenic storage tank to the manifold with the return line returning the cryogenic liquified gas to the bulk cryogenic storage tank;

placing a transfer tank on the weigh platform;

connecting the transfer tank connector on the delivery line to the transfer tank;

setting the scale program input and scale display to zero using the tare means;

activating the liquified gas pump causing the cryogenic liquified gas to begin circulating in the fill station, the three-way solenoid directing the cryogenic liquified gas to the return line;

programming the appropriate weighed amount of liquified gas into the electronic control panel on the scale program input;

verifying the programmed weight;

opening the transfer tank;

depressing the start relay causing the liquified gas to be directed to the delivery line into the transfer tank, the cryogenic liquified gas flowing to the transfer tank until the programmed weight is attained, whereupon the electronic control panel causes the three-way solenoid to direct the flow of liquified gas to the return line, removing the flow of liquified gas to the delivery line;

closing the transfer tank;

opening the emergency bypass valve, directing any remaining liquified gas from the delivery line to the return line;

disconnecting the transfer tank from the transfer tank connector;

repeating the above steps until all transfer tanks are filled;

powering down the liquified gas pump; and finally opening the purge valve to relieve any trace liquified gases that may remain in the liquified gas fill station.

* * * * *